US009921026B1

(12) United States Patent
Anderson

(10) Patent No.: US 9,921,026 B1
(45) Date of Patent: Mar. 20, 2018

(54) ELONGATED-DRAW COMPACT CROSSBOW

(71) Applicant: Jeffrey R. Anderson, Wauconda, IL (US)

(72) Inventor: Jeffrey R. Anderson, Wauconda, IL (US)

( * ) Notice: Subject to any disclaimer, the term of this patent is extended or adjusted under 35 U.S.C. 154(b) by 0 days.

(21) Appl. No.: 15/585,760

(22) Filed: May 3, 2017

(51) Int. Cl.
*F41B 5/12* (2006.01)
*F41B 5/14* (2006.01)

(52) U.S. Cl.
CPC ..... *F41B 5/1469* (2013.01); *F41B 5/123* (2013.01); *F41B 5/12* (2013.01); *F41B 5/14* (2013.01); *F41B 5/143* (2013.01)

(58) Field of Classification Search
CPC ..... F41B 5/12; F41B 5/123
See application file for complete search history.

(56) References Cited

U.S. PATENT DOCUMENTS

| | | | | |
|---|---|---|---|---|
| 4,829,974 | A | 5/1989 | Anderson | |
| 4,958,617 | A | 9/1990 | Anderson | |
| 5,119,797 | A | 6/1992 | Anderson | |
| 5,263,465 | A | 11/1993 | Anderson | |
| 5,649,520 | A | 7/1997 | Bednar | |
| 6,142,133 | A | 11/2000 | Anderson | |
| 6,715,481 | B1 | 4/2004 | Anderson | |
| 6,752,136 | B1 | 6/2004 | Anderson | |
| 7,823,572 | B2 | 11/2010 | Anderson | |
| 8,127,752 | B2 * | 3/2012 | Bednar | F41C 23/16 124/25 |
| 8,157,680 | B2 | 4/2012 | Anderson | |
| 8,220,445 | B2 * | 7/2012 | Bednar | F41B 5/123 124/25 |
| 8,800,540 | B1 * | 8/2014 | Choma | F41B 5/12 124/25 |
| 9,004,053 | B1 | 4/2015 | Anderson | |
| 9,494,380 | B1 | 11/2016 | Yehle | |
| 2010/0012108 | A1 * | 1/2010 | Bednar | F41B 5/123 124/25 |

* cited by examiner

*Primary Examiner* — John Ricci
(74) *Attorney, Agent, or Firm* — Rolland Hackbart

(57) ABSTRACT

An improved elongated-draw compact crossbow (150) includes a riser (101), stirrup (100), right and left split limbs (102) each having a first end coupled to the riser (101), right and left cams (104 and 103) with axles coupled to respective second ends of the right and left split limbs (102), string (105) and harness coupled to right and left cams (104 and 103), and a rifle-type stock (110) with a substantially rectangular-shaped barrel (109) having a bore end and butt end and being coupled to the stock (110). When the string (105) of the crossbow (150) is fully drawn and cocked, covers (108 and 107) may be pivoted on the cylindrical rods of respective brackets (106) until they rest against the side of the barrel (109) and cover the string (105) when cocked. Another improved elongated-draw compact crossbow (160) includes a single cover (113) coupled to a hinge (112) the top side of the barrel (109) that rotates on the hinge (112) down until it rests against the top side of the barrel (109) and two portions of the cover (113) extend down over the string (105) when cocked.

17 Claims, 5 Drawing Sheets

ELONGATED-DRAW COMPACT CROSSBOW

TECHNICAL FIELD

The present invention relates generally to the field of archery crossbows, and more particularly to an improved elongated-draw compact crossbow that has a longer power stroke and is more compact than conventional crossbows.

BACKGROUND

A conventional crossbow with a tubular barrel is illustrated in FIG. 1 of my U.S. Pat. No. 5,119,797. The string release of conventional crossbows must be located a sufficient distance in front of the butt end of the crossbow stock so that the cocked bow string is in front of the shooter's face when aiming and shooting. Thus, the draw length of a conventional crossbow is limited to the distance from the riser to the forward-located string release which typically is less than 17 inches. Although the crossbow illustrated in FIG. 1 of my U.S. Pat. No. 7,823,572 has an elongated draw, it is bulky, heavy and difficult to maneuver due to its overall size. Accordingly, there is a need for an improved elongated-draw compact crossbow that has a longer power stroke and is more compact than conventional crossbows.

DETAILED DESCRIPTION OF THE DRAWINGS

A crossbow illustrative of my invention comprises: first and second limbs, each having first and second ends; a riser to receive the first end of the first and second limbs; a first cam with an axle to couple to the second end of the first limb, the first cam having an outside perimeter; a second cam with an axle to couple to the second end of the second limb, the second cam having an outside perimeter; a string extending between the first cam and the second cam; a string release adapted to hold the string when the crossbow is cocked; a stock having a bore end and a butt end, the stock including a grip, a trigger coupled to the string release, and a barrel having a bore end and a butt end coupled to the stock, the respective bore ends of the stock and barrel coupled to the riser, the barrel adapted to receive a crossbow bolt, and the string release coupled to the barrel behind a shooter's face when aiming and shooting; and a cover coupled to one of the stock or the barrel near the butt end thereof and adapted to rotate toward the barrel to cover the string after the string is cocked and held by the string release.

Figure 1:
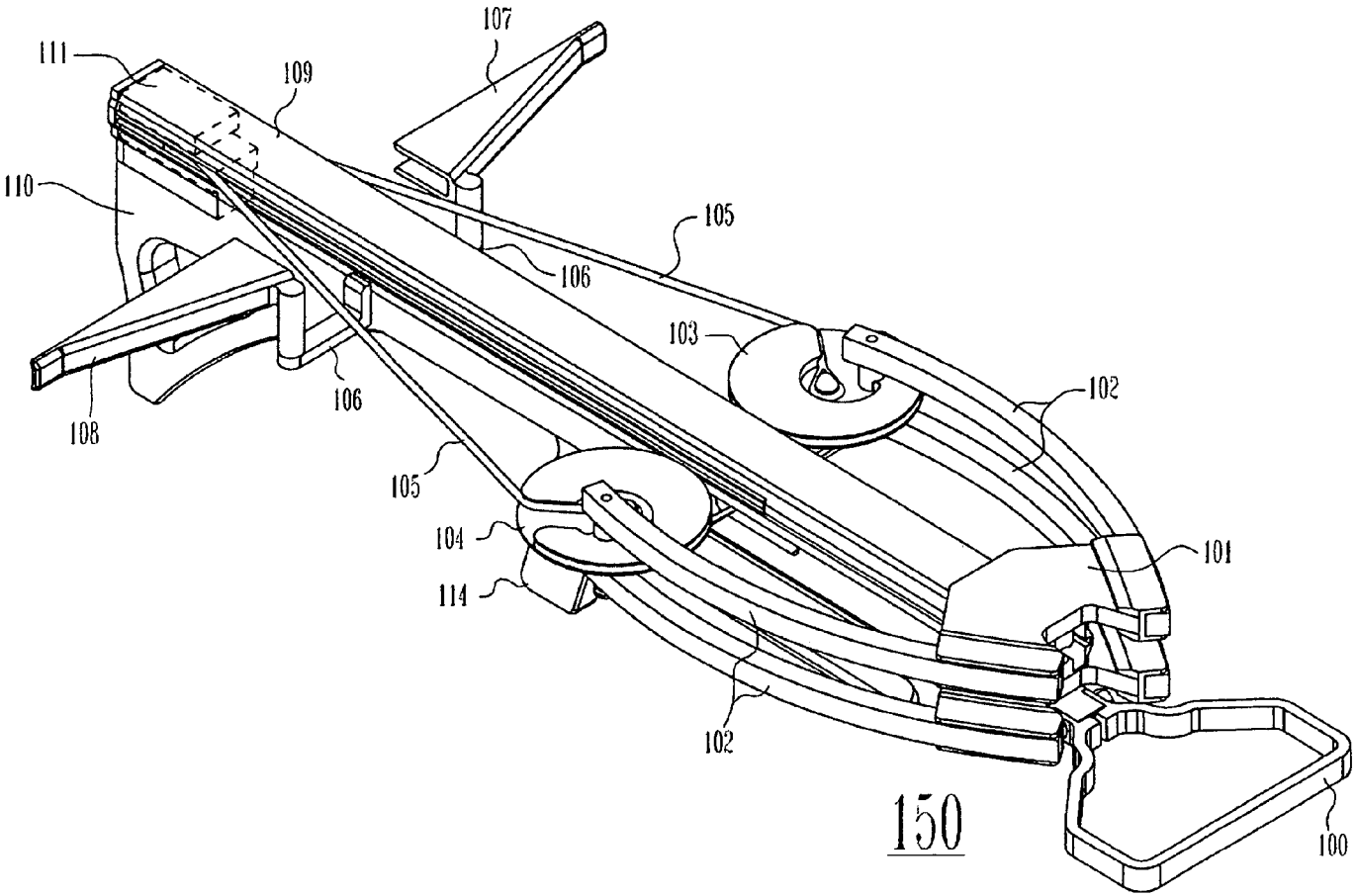
FIG. 1 is a right-side perspective view of an improved elongated-draw compact crossbow with the string in cocked position and the string covers in the open position, illustrative of an embodiment of my invention.

Referring now to FIG. 1, there is illustrated a right-side perspective view of an improved elongated-draw compact crossbow 150 with the string 105 in cocked position and right and left string covers 108 and 107 in the open position, illustrative of an embodiment of my invention. The crossbow 150 includes a riser 101, stirrup 100, right and left split limbs 102 each having a first end coupled to the riser 101, right and left cams 104 and 103 with axles coupled to respective second ends of the right and left split limbs 102, string 105 and harness coupled to right and left cams 104 and 103, and a rifle-type stock 110 with a substantially rectangular-shaped barrel 109 (may be tubular or any suitable shape for holding a crossbow bolt) having a bore end and butt end and being coupled to the stock 110. The bore end of the stock 110 and the barrel 109 are coupled between the top portion and bottom portion of the riser 101. The rifle-type stock 110 and the barrel 109 may be one piece or separate pieces of the same or different materials attached or otherwise coupled to one another. The rifle-type stock 110 includes a forearm 117, a pistol-type grip 114, a trigger 115 (see FIG. 5), and a shoulder rest. The barrel 109 is comprised of an elongated track with a slot in each side extending from near the bore end to near the butt end of the barrel 109 for allowing the string 105 and harness to pass through the barrel 109 when uncocked, during cocking and when cocked. The two string covers 108 and 107 shown in the open position are coupled by respective brackets 106 to the stock 110 near the butt end of the barrel 109. The string covers 108 and 107 may rotate on their respective brackets 106 to a closed position (up against the barrel 109) to cover the string 105 in the cocked position (drawn back and captured by release 111). The string covers 108 and 107 rotate on their respective brackets 106 to cover the portion of string 105 that is behind a user's face when aiming and shooting. The crossbow 150 includes two string covers 108 and 107 so that it may be shot either right handed or left handed. In other embodiments of my invention, the crossbow 150 need only include one string cover 108 or 107 for a right-hand only or left hand only crossbow, respectively. The string 105 may be drawn back to the cocked position by hand, a rope cocking device, or a crank-type cocking device (suitably attached to the shoulder rest of the stock 110 for example). A conventional string release 111 (shown in dashed lines in FIG. 1) is coupled to the barrel 109 near the butt end of the stock 110 so that it is behind a shooter's face when aiming and shooting. The string release 111 is also coupled to the trigger 115 disposed near grip 114. In other embodiments of my invention, the string release 111 may be coupled at any point to the barrel 109 between the butt end thereof and behind a shooter's face when aiming and shooting. A standard crossbow bolt with a nock and a hunting or field tip may be inserted into the barrel 109 at the bore end when the crossbow 150 is cocked and is captured by the string release 111 at the butt end of the barrel 109 (a spring may assert a force against the nock end of the bolt to keep it in place in the barrel 109). The barrel 109 may be similar to the tubular barrel illustrated and described in my U.S. Pat. Nos. 5,119,797, 6,142,133, 6,752,136, 6,752,136 and 7,823,572, incorporated herein in their entirety by reference. The string release 111 may be any conventional string release used in crossbows such as, for example, the string release illustrated and described in my U.S. Pat. Nos. 5,119,797 and 9,004,053, incorporated herein in their entirety by reference.

Figure 2:
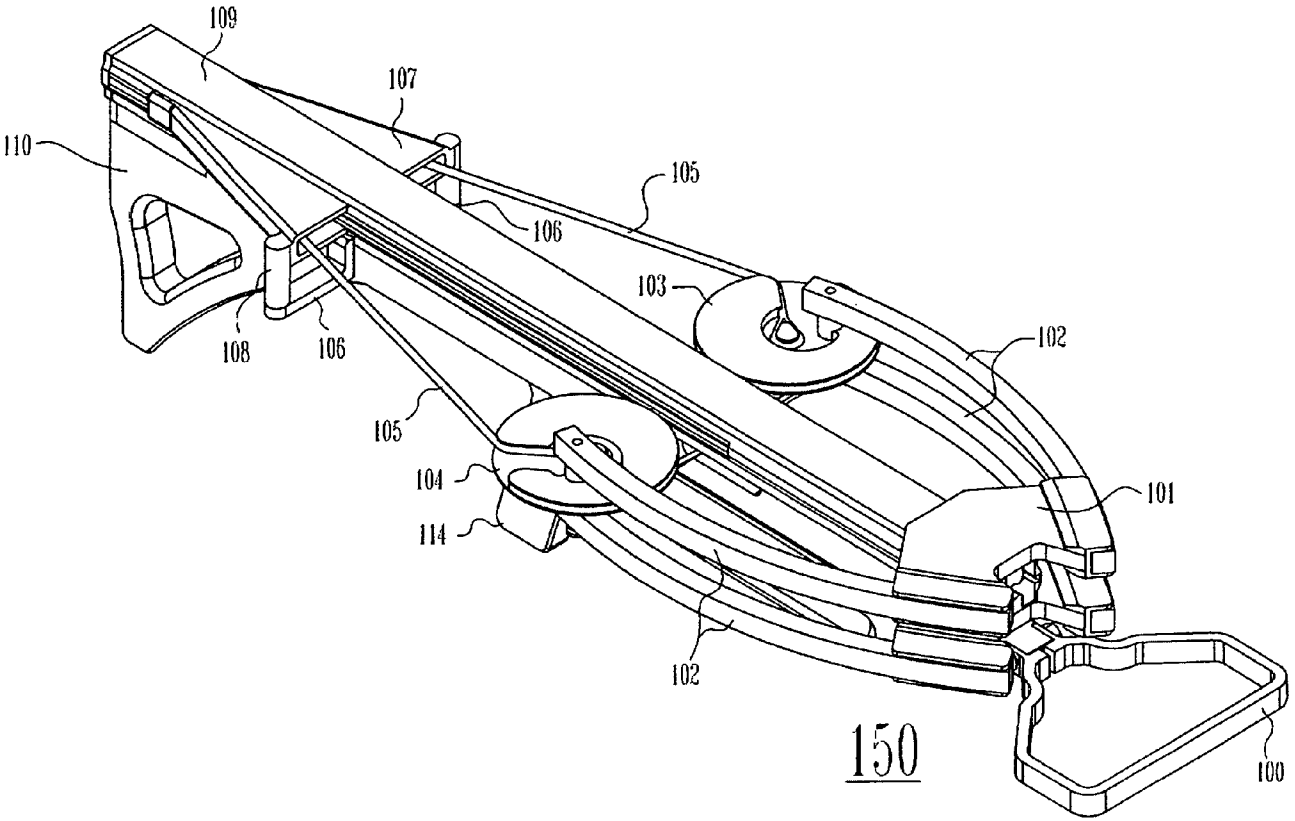
FIG. 2 is a right-side perspective view of the improved elongated-draw compact crossbow in FIG. 1, with the string in cocked position and the string covers in the closed position.

Referring now to FIG. 2, there is illustrated a right-side perspective view of the crossbow 150 in FIG. 1, showing the string 105 in cocked position and the string covers 108 and 107 in the closed position. The string covers 108 and 107 in FIGS. 1 and 2 have end tabs at the free end, U-shaped channels and cylindrical end tubes that slip over corresponding cylindrical rods of the brackets 106. In order to cock the crossbow 150, a shooter places it against the ground and puts his foot within the stirrup 100. The shooter may then draw the string 105 by hand or with a rope cocking device against the force of the crossbow limbs 102 to store energy in the crossbow limbs 102. When the string 105 is fully drawn, it is held in the cocked position by the string release 111. The string covers 108 and 107 may now be rotated toward the barrel 109 until their respective end tabs rest against the sides of the barrel 109. The string covers 108 and 107 enclose but do not touch the string 105 when closed. Since the string 105 is covered by the string covers 108 and 107, the string 105 will not touch or otherwise contact the shooter's face on release of a bolt from crossbow 150 or in the unlikely event that the string 105 should break or otherwise separate from the cams 104 and 103. To insure that string covers 108 and 107 do not open or rattle when the string 105 is released by pulling the trigger 115, retaining springs, clips, snaps, Velcro strips, magnets, or other suitable capture devices may be incorporated by a person skilled in the art to hold the string covers 108 and 107 in the closed position against respective sides of the barrel 109. In other embodiments of my invention, string covers 108 and 107 may be mounted on respective hinges (see hinge 112 in FIG. 5 for example) on the side of the stock 110 and rotate up to cover the cocked string 105.

Figure 3:
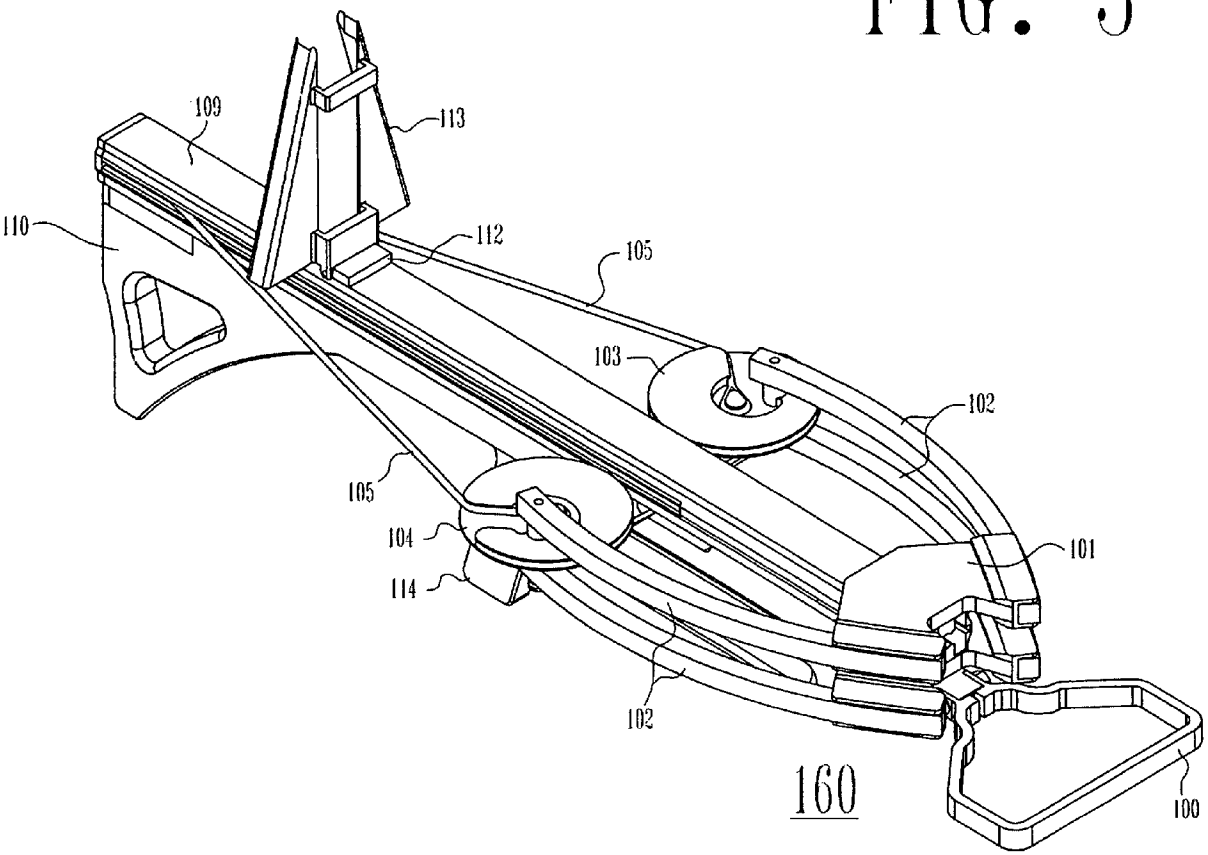
FIG. 3 is a right-side perspective view of an improved elongated-draw compact crossbow with the string in cocked position and the string cover in the open position, illustrative of another embodiment of my invention.

Referring now to FIG. 3, there is illustrated a right-side perspective view of an improved elongated-draw compact crossbow 160 with the string 105 in cocked position and the string cover 113 in the open position, illustrative of another embodiment of my invention. Components of the crossbow 160 in FIGS. 3, 4 and 5 that are the same as corresponding components of the crossbow 150 in FIG. 1 have been given the same references numbers. The string cover 113 is coupled to the hinge 112 on the top of barrel 109 and rotates on the hinge 112 up to the open position so that the string 105 may be cocked.

Figure 4:
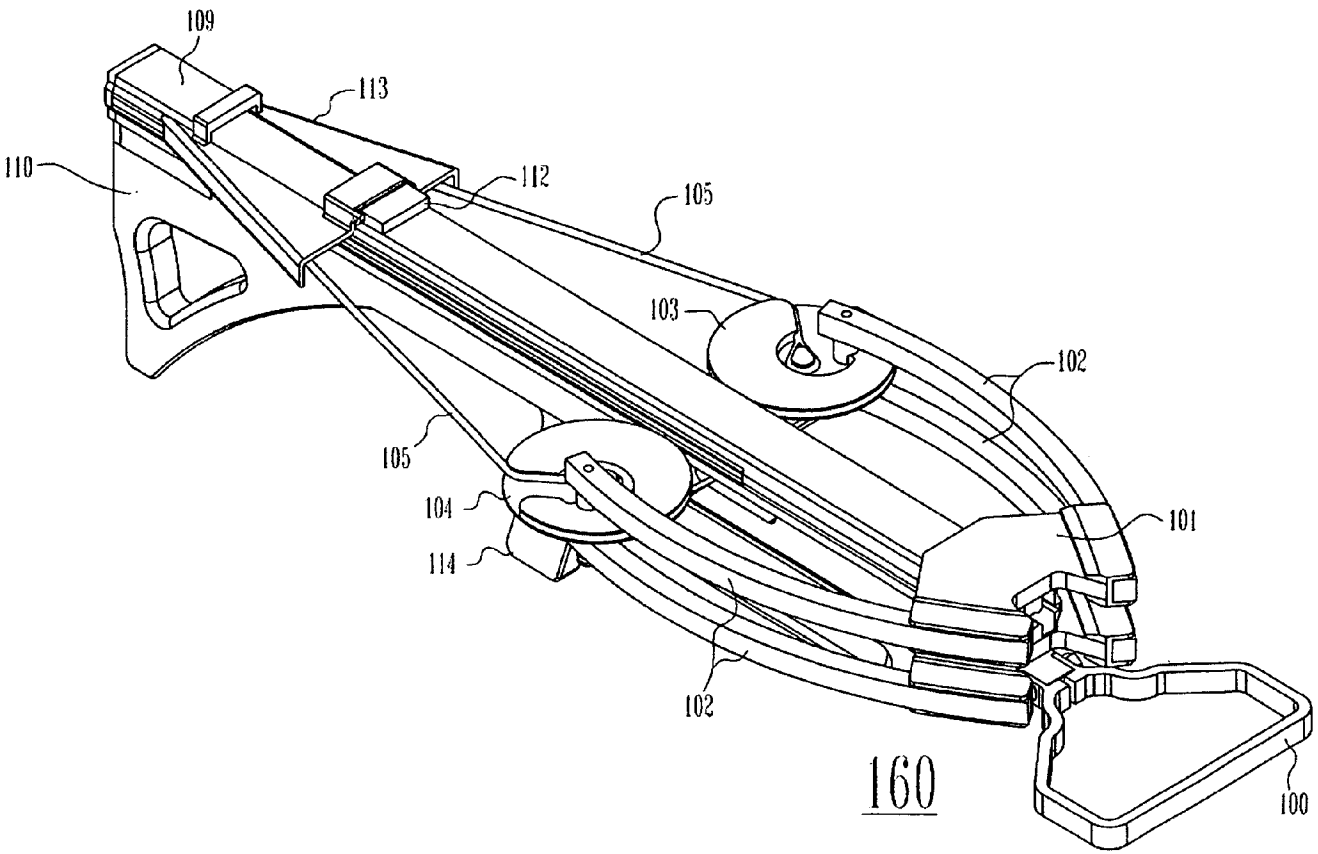
FIG. 4 is a right-side perspective view of the improved elongated-draw compact crossbow in FIG. 3, with the string in cocked position and the string cover in the closed position.

Referring now to FIG. 4, there is illustrated a right-side perspective view of the improved elongated-draw compact crossbow 160 in FIG. 3, with the string 105 in cocked position and the string cover 113 in the closed position. The string cover 113 has right and left cover portions. Once the string 105 is cocked, the string cover 113 may be rotated on the hinge 112 down to rest against the top of the barrel 109 so that the right and left cover portions extend down over the string 105.

Figure 5:
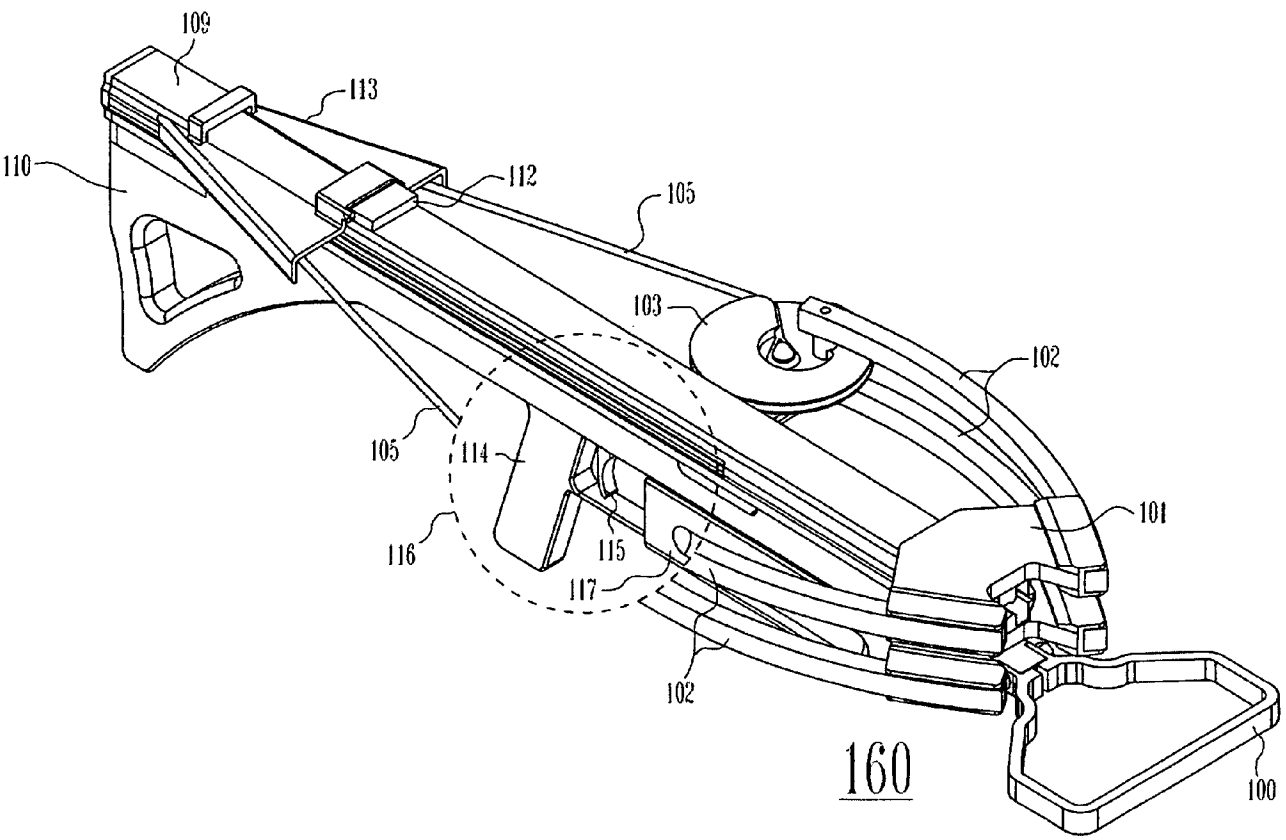
FIG. 5 is a right-side perspective view of the improved elongated-draw compact crossbow in FIG. 4, with the string in cocked position and the string cover in the closed position, where a cut-away exposes the pistol grip and trigger.

Referring now to FIG. 5, there is illustrated is a right-side perspective view of the improved elongated-draw compact crossbow 160 in FIG. 4, with the string 105 in cocked position and the string cover 113 in the closed position, where a cut-away exposes the pistol grip 114, the trigger 115 and a portion of the forearm 117 of stock 110. In FIG. 1, FIG. 2, FIG. 3 and FIG. 4, the pistol grip 114, the trigger 115 and the forearm 117 of stock 110 are covered at least in part by the right cam 104 and right split limbs 102.

According to a feature of the novel crossbow 150 illustrated in FIGS. 1 and 2 and the novel crossbow 160 illustrated in FIGS. 3, 4 and 5, the respective outside perimeters of the right and left cams 104 and 103 are relatively close to the barrel 109 when the string 105 is cocked. For example, the respective outside perimeters of the right and left cams 104 and 103 may be within one-sixteenth inch to two inches from the barrel 109 when the string 105 is cocked. In other embodiments of my invention, the respective perimeters of the right and left cams 104 and 103 of crossbows 150 and 160 may extend partially into the string slot in the barrel 109 provided that the portion of the string slot adjacent to the right and left cams 104 and 103 is made large enough to fit them when the string is cocked.

Thus, a novel crossbow described above and illustrated by the embodiments in the attached drawings has a draw length longer than the draw length of conventional crossbows and also is more compact than conventional crossbows, thereby providing a longer power stroke with less draw weight, a smaller axle-to-axle length when cocked, and a shorter length from the bore end to the butt end. My novel crossbow is lighter, smaller in overall size, and more maneuverable than conventional crossbows.

While particular embodiments of my invention have been shown and described, modifications may be made to the embodiments by routineers skilled in the art. It is therefore intended in the appended claims to cover all such modifications which fall within the true spirit and scope of my invention.

What is claimed is:

1. A crossbow, comprising:

first and second limbs, each having first and second ends;

a riser to receive the first end of the first and second limbs;

a first cam with an axle to couple to the second end of the first limb, the first cam having an outside perimeter;

a second cam with an axle to couple to the second end of the second limb, the second cam having an outside perimeter;

a string extending between the first cam and the second cam;

a string release adapted to hold the string when the crossbow is cocked;

a stock having a bore end and a butt end, the stock including a grip, a trigger coupled to the string release, and a barrel having a bore end and a butt end coupled to the stock, the respective bore ends of the stock and barrel coupled to the riser, the barrel adapted to receive a crossbow bolt, and the string release coupled to the barrel behind a shooter's face when aiming and shooting; and a cover coupled to one of the stock or the barrel near the butt end thereof and adapted to rotate toward the barrel to cover the string after the string is cocked and held by the string release, and the respective outside perimeters of the first cam and the second cam being disposed within two inches of the barrel when the string is cocked.

2. The crossbow according to claim 1, wherein the barrel has two sides and a slot in each side through which the string passes and protrudes from each of the two sides near the butt end when cocked, wherein the cover rotates toward one side of the barrel to cover the protruding string when the string is cocked.

3. The crossbow according to claim 1, wherein the barrel has two sides and a slot in each side through which the string passes and protrudes from each of the two sides near the butt end when cocked, wherein the cover rotates toward one side of the barrel to cover the protruding string when the string is cocked, and wherein the crossbow further includes another cover that rotates toward the other side of the barrel to cover the protruding string when the string is cocked.

4. The crossbow according to claim 1, wherein the one of the stock or the barrel further includes a rod, the cover being coupled to the rod and adapted to rotate on the rod toward the barrel to cover the string after the string is cocked and held by the string release.

5. The crossbow according to claim 1, wherein the crossbow further includes a stirrup, a shooter stepping on the stirrup while drawing and cocking the string.

6. A crossbow, comprising:

first and second limbs, each having first and second ends;

a riser to receive the first end of the first and second limbs;

a first cam with an axle to couple to the second end of the first limb, the first cam having an outside perimeter;

a second cam with an axle to couple to the second end of the second limb, the second cam having an outside perimeter;

a string extending between the first cam and the second cam;

a string release adapted to hold the string when the crossbow is cocked;

a stock having a bore end and a butt end, the stock including a grip, a trigger coupled to the string release, and a barrel having a bore end and a butt end coupled to the stock, the respective bore ends of the stock and barrel coupled to the riser, the barrel adapted to receive a crossbow bolt, and the string release coupled to the barrel behind a shooter's face when aiming and shooting; and a cover coupled by a hinge to one of the stock or the barrel near the butt end, the cover adapted to rotate on the hinge toward the barrel to cover the string after the string is cocked and held by the string release, and the respective outside perimeters of the first cam and the second cam being disposed within two inches of the barrel when the string is cocked.

7. The crossbow according to claim 6, wherein the hinge is coupled to a top side of the barrel, and wherein the cover has a first portion and a second portion that rotate on the hinge toward the top side of the barrel to cover the string after the string is cocked.

8. The crossbow according to claim 6, wherein the hinge is coupled to a side of the barrel, and wherein the cover rotates on the hinge toward the side of the barrel to cover the string after the string is cocked.

9. The crossbow according to claim 6, wherein the barrel has two sides and a slot in each side through which the string passes and protrudes from each of the two sides near the butt end when cocked, wherein the cover rotates toward one side of the barrel to cover the protruding string when the string is cocked.

10. The crossbow according to claim 6, wherein the barrel has two sides and a slot in each side through which the string passes and protrudes from each of the two sides near the butt end when cocked, wherein the cover rotates toward one side of the barrel to cover the protruding string when the string is cocked, and wherein the crossbow further includes another cover that rotates toward the other side of the barrel to cover the protruding string when the string is cocked.

11. The crossbow according to claim 6, wherein the crossbow further includes a stirrup, a shooter stepping on the stirrup while drawing and cocking the string.

12. A crossbow, comprising:

first and second limbs, each having first and second ends;

a riser to receive the first end of the first and second limbs;

a first cam with an axle to couple to the second end of the first limb, the first cam having an outside perimeter;

a second cam with an axle to couple to the second end of the second limb, the second cam having an outside perimeter;

a string extending between the first cam and the second cam;

a string release adapted to hold the string when the crossbow is cocked;

a stock having a bore end and a butt end, the stock including a grip, a trigger coupled to the string release, and a barrel having a bore end and a butt end coupled to the stock, the respective bore ends of the stock and barrel coupled to the riser, the barrel adapted to receive a crossbow bolt, and the string release coupled to the barrel behind a shooter's face when aiming and shooting; and a cover coupled to one of the stock or the barrel near the butt end thereof and adapted to rotate toward the barrel to cover the string after the string is cocked and held by the string release.

13. The crossbow according to claim 12, wherein the barrel has two sides and a slot in each side through which the string passes and protrudes from each of the two sides near the butt end when cocked, wherein the cover rotates toward one side of the barrel to cover the protruding string when the string is cocked.

14. The crossbow according to claim 12, wherein the barrel has two sides and a slot in each side through which the string passes and protrudes from each of the two sides near the butt end when cocked, wherein the cover rotates toward one side of the barrel to cover the protruding string when the string is cocked, and wherein the crossbow further includes another cover that rotates toward the other side of the barrel to cover the protruding string when the string is cocked.

15. The crossbow according to claim 12, wherein the one of the stock or the barrel further includes a rod, the cover being coupled to the rod and adapted to rotate on the rod toward the barrel to cover the string after the string is cocked and held by the string release.

16. The crossbow according to claim 12, wherein the one of the stock or the barrel further includes a hinge, the cover being coupled to the hinge and adapted to rotate on the hinge toward the barrel to cover the string after the string is cocked and held by the string release.

17. The crossbow according to claim 12, wherein the crossbow further includes a stirrup, a shooter stepping on the stirrup while drawing and cocking the string.

* * * * *